US012564212B2

(12) United States Patent
Camus et al.

(10) Patent No.: US 12,564,212 B2
(45) Date of Patent: Mar. 3, 2026

(54) AEROSOL-GENERATING ARTICLE HAVING BRIDGING ELEMENT WITH REFLECTANCE FACTOR

(71) Applicant: PHILIP MORRIS PRODUCTS S.A., Neuchatel (CH)

(72) Inventors: Alexandre Camus, Colombier (CH); Yalin Ciftcioglu, Peseux (CH); Levent Lekili, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 432 days.

(21) Appl. No.: 17/800,606

(22) PCT Filed: Feb. 19, 2021

(86) PCT No.: PCT/EP2021/054221
§ 371 (c)(1),
(2) Date: Aug. 18, 2022

(87) PCT Pub. No.: WO2021/165502
PCT Pub. Date: Aug. 26, 2021

(65) Prior Publication Data

US 2023/0292816 A1 Sep. 21, 2023

(30) Foreign Application Priority Data

Feb. 20, 2020 (EP) ..... 20158546

(51) Int. Cl.
*A24C 5/01* (2020.01)
*A24C 5/47* (2006.01)
(Continued)

(52) U.S. Cl.
CPC ..... *A24D 1/025* (2013.01); *A24C 5/01* (2020.01); *A24C 5/471* (2013.01); *A24D 1/045* (2013.01); *A24D 1/20* (2020.01)

(58) Field of Classification Search
CPC ..... A24D 1/025; A24C 5/471
See application file for complete search history.

(56) References Cited

U.S. PATENT DOCUMENTS 3,064,541 A 11/1962 Ivanov
3,065,756 A 11/1962 Noel
(Continued)

FOREIGN PATENT DOCUMENTS

CN 104921296 9/2015
CN 107981411 5/2018
(Continued)

OTHER PUBLICATIONS

PCT Search Report and Written Opinion for PCT/EP2021/054221 dated Aug. 27, 2021 (14 pages).
(Continued)

*Primary Examiner* — Michael H. Wilson
*Assistant Examiner* — Ronnie Kirby Jordan
(74) *Attorney, Agent, or Firm* — Mueting Raasch Group

(57) ABSTRACT

An aerosol-generating article (10) comprising a rod (20) comprising an aerosol-generating substrate (22); a filter (30) in axial alignment with the rod (20); a bridging element (40) comprising a first wrapper (42), the first wrapper circumscribing the rod (20) and the filter and securing the filter to the rod; and a cavity (44) located between the rod and the filter, the cavity (44) being partially delimited by the inner surface of the first wrapper (42) in a first portion of the bridging element (40), wherein the first portion of the bridging element has a reflectance factor of 85 percent or higher.

15 Claims, 3 Drawing Sheets

(51) Int. Cl.

| | |
|---|---|
| ***A24D 1/02*** | (2006.01) |
| ***A24D 1/04*** | (2006.01) |
| ***A24D 1/20*** | (2020.01) |

(56) References Cited

U.S. PATENT DOCUMENTS

| | | | | |
|---|---|---|---|---|
| 3,283,762 | A | 11/1966 | Kissel | |
| 4,718,436 | A * | 1/1988 | Luke | A24D 3/04 131/336 |
| 4,776,354 | A | 10/1988 | Norman | |
| 4,920,354 | A | 4/1990 | Rauser | |
| 5,628,452 | A * | 5/1997 | Sigrist et al. | B65D 5/54 229/235 |
| 7,984,719 | B2 | 7/2011 | Dube | |
| 9,775,380 | B2 | 10/2017 | Fernando | |
| 2011/0030705 | A1 | 2/2011 | Koshaka | |
| 2012/0000477 | A1 | 1/2012 | Sebastian | |
| 2013/0146075 | A1* | 6/2013 | Poget et al. | A24F 47/00 131/360 |
| 2016/0114963 | A1 | 4/2016 | Reed | |
| 2016/0150817 | A1 | 6/2016 | Guyard | |
| 2018/0160726 | A1 | 6/2018 | Kadiric | |
| 2019/0191757 | A1* | 6/2019 | Shieh | A24D 1/04 |
| 2020/0281260 | A1* | 9/2020 | Jordil et al. | A24D 3/06 |

FOREIGN PATENT DOCUMENTS

| | | | |
|---|---|---|---|
| EP | 2888955 | 7/2015 | |
| EP | 2579736 | 12/2018 | |
| FR | 2497636 | 7/1982 | |
| JP | 3108906 | 11/1996 | |
| JP | 2007-520204 | 7/2007 | |
| JP | 2010-504091 | 2/2010 | |
| JP | 2012-507287 | 3/2012 | |
| JP | 2012-527222 | 11/2012 | |
| JP | 2015-033330 | 2/2015 | |
| WO | WO 2009/027331 | 3/2009 | |
| WO | WO 2010/051076 | 5/2010 | |
| WO | WO 2012/061249 | 5/2012 | |
| WO | WO 2013/179428 | 12/2013 | |
| WO | WO 2015/007399 | 1/2015 | |
| WO | WO 2017/013105 | 1/2017 | |
| WO | WO 2019/105950 | 6/2019 | |
| WO | WO 2019/105950 A1 * | 6/2019 | A24D 3/06 |
| WO | WO 2019/123645 | 6/2019 | |
| WO | WO 2019/207302 | 10/2019 | |

OTHER PUBLICATIONS

Extended European Search Report for Application No. 20158546.0 dated Sep. 10, 2020 (7 pages).

Office Action issued in Japan for Application No. 2022-549926 dated Feb. 27, 2025 (10 pages). English translation included.

* cited by examiner

AEROSOL-GENERATING ARTICLE HAVING BRIDGING ELEMENT WITH REFLECTANCE FACTOR

This application is a U.S. National Stage Application of International Application No. PCT/EP2021/054221 filed Feb. 19, 2021, which was published in English on Aug. 26, 2021, as International Publication No. WO 2021/165509 A1. International Application No. PCT/EP2021/054221 claims priority to European Application No. 20158546.0 filed Feb. 20, 2020.

The present disclosure relates to aerosol-generating articles, for example cigarettes or heated aerosol-generating articles.

Filter cigarettes typically comprise a rod of aerosol-generating substrate in the form of tobacco cut filler surrounded by a paper wrapper and a cylindrical filter aligned in an end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

Generally, a consumer smokes a cigarette until the burning area of the tobacco rod (the lit end) reaches the edge of the tipping paper. At this point, the proximity of the burning area to the filter results in burning or excessive heating of the filter which can negatively affect the taste and flavour of the mainstream smoke produced by the cigarette.

Aerosol-generating articles for the generation of an aerosol by heating rather than burning are known in the art. One example of such aerosol-generating articles comprises an aerosol-generating substrate penetrable by a heating element of an aerosol-generating device. The aerosol-generating substrate is, preferably, a solid substrate and comprises tobacco. The heating element heats the aerosol-generating substrate to generate an aerosol that a user can draw through a filter at the mouth end of the aerosol-generating article. Alternatively or additionally, the aerosol-generating substrate may be heatable by a susceptor. In such cases, the aerosol-generating device may comprise an inductor coil through which an alternating current is passed to generate an alternating magnetic field. This induces a voltage in the susceptor such that the susceptor is heated which, in turn, heats the aerosol-generating substrate. The susceptor may be a part of the aerosol-generating article or a part of the aerosol-generating device. In each of these arrangements, the aerosol-generating substrate may be heated to temperatures of around 300 degrees Celsius or more. As a result, in such arrangements, it may also be desirable to avoid excessive heating of the filter.

It would therefore by desirable to provide an aerosol-generating article in which unwanted heating or burning of elements of the aerosol-generating article downstream of the aerosol-generating substrate is avoided.

In this disclosure there is provided an aerosol-generating article. The aerosol-generating article may comprise a rod. The rod may comprise an aerosol-generating substrate. The aerosol-generating article may also comprise a filter. The filter may be in axial alignment with the rod. The aerosol-generating article may also comprise a bridging element. The bridging element may comprise a first wrapper. The first wrapper may circumscribe the rod. The first wrapper may circumscribed the filter. The first wrapper may circumscribe the rod and the filter. The first wrapper may secure the filter to the rod. The first wrapper may permanently secure the filter to the rod. The aerosol-generating article may comprise a cavity. The cavity may be located between the rod and the filter. The cavity may be being partially delimited by the inner surface of the first wrapper in a first portion of the bridging element. The first portion of the bridging element may have a reflectance factor of 85 percent or higher.

In one example, the aerosol-generating article comprises a rod comprising an aerosol-generating substrate; a filter in axial alignment with the rod; a bridging element comprising a first wrapper, the first wrapper circumscribing the rod and the filter and securing the filter to the rod; and a cavity located between the rod and the filter, the cavity being partially delimited by the inner surface of the first wrapper in a first portion of the bridging element, wherein the first portion of the bridging element has a reflectance factor of 85 percent or higher.

The provision of a cavity between the rod and filter advantageously reduces the risk of excessive heating or burning of the filter when the aerosol-generating article is consumed.

The aerosol-generating article may be consumed as a result of ignition of the aerosol-generating substrate. The provision of a cavity between the rod comprising the aerosol-generating substrate and the filter reduces the proximity of the burning area of the aerosol-generating substrate to the filter, even when the burning area reaches the end of the rod.

The aerosol-generating article may be consumed by heating, rather than burning, the aerosol-generating substrate. The provision of a cavity between the rod comprising the aerosol-generating substrate and the filter ensures that the filter is not excessively heated.

The provision of a bridging element comprising a first wrapper that secures the filter and the rod and which has an inner surface that partially delimits the cavity may result in an aerosol-generating article that is simple and cheap to manufacture.

The first portion of the bridging element is a portion having a reflectance of 85 percent or higher. The bridging element may comprise a first wrapper. In some embodiments, the first wrapper may have a portion having a reflectance of 85 percent or higher. This portion of the first wrapper may correspond to the first portion of the wrapper. In some embodiments the bridging element may comprise more than one wrapper. For example, the bridging element may comprise a portion of a first wrapper and a portion of a second wrapper. The second wrapper may circumscribe the first wrapper. In that case, the portion having a reflectance of 85 percent or higher may be a result of combined reflectance factor of the two or more layers. In any case, the cavity may be partially delimited by the inner surface of the first wrapper in the first portion of the bridging element.

Providing a first portion of the bridging element partially delimiting the cavity and having a reflectance factor of 85 percent or higher may result in the cavity not being visibly discernible through the bridging element when the aerosol-generating article is viewed from the outside and in normal lighting conditions. A user of the aerosol-generating article might consider an aerosol-generating article having a visible cavity as being faulty. Preferably, the inner surface of first wrapper in the first portion of the bridging element may extend around extend around the some or all of the circumference of the cavity.

The portion of the bridging element delimiting the cavity may have a reflectance factor of 85 percent or higher for light incident on the outer surface of the bridging element. The reflectance factor may not be the same when measured for light incident on the outer surface of the bridging element compared to light incident on the inner surface of the first wrapper. The cavity is visible if light from the surroundings is transmitted through the bridging element, from the outer surface to the inner surface of the first wrapper. Therefore, a reflectance factor of 85 percent or higher for light incident on the outer surface is advantageous to reduce the visibility of the cavity.

Preferably, the first portion of the bridging element has a reflectance factor of 90 percent or higher. Even more preferably, the portion of the bridging element delimiting the cavity has a reflectance factor of 95 percent or higher.

The portion of the bridging element delimiting the cavity having a reflectance factor of 85 percent or higher refers to the reflectance factor of the bridging element when the bridging element is separate to the aerosol-generating article rather than the reflectance factor of the bridging element on the assembled aerosol-generating article. In the assembled aerosol-generating article, the reflectance factor of the bridging element in region of the cavity may be 85 percent or higher. Furthermore, in the assembled aerosol-generating article the reflectance factor of the bridging element in the region of the filter may be greater than or equal to the reflectance factor of the of the bridging element in region of the cavity.

The first wrapper may permanently secure the rod to the filter. The first wrapper of the bridging element may comprise an adhesive to permanently secure the filter to the rod. In particular, the inner surface of the first wrapper of the bridging element may comprise adhesive to permanently secure the first wrapper to the filter. Alternatively or additionally, the inner surface of the first wrapper of the bridging element may comprise adhesive to permanently secure the first wrapper to the rod. The first wrapper may be glued to the rod. The first wrapper may be glued to the filter.

As used herein, the term "reflectance factor" is a measure of the opacity of a sample. In other words, "reflectance factor" is a measure of a sample's ability to obstruct the passage of light. Reflectance factor is calculated as the ratio of the luminous reflectance factor of a single sample against a black backing and the intrinsic luminous reflectance factor of the sample. The higher the reflectance factor, the lower the amount of light passing through the sample.

As used herein, the term "luminous reflectance factor" is the ratio of the luminous power reflected by the sample (i.e. reflected by the incident surface of the objection) and the incident luminous power. Luminous power can be measured using a reflectometer, for example a Spectrophotometer Datacolor 800V.

As used herein, the term "intrinsic luminous reflectance factor" is the luminous reflectance factor of a stack of identical samples thick enough to be considered opaque. A stack is considered to be opaque when increasing the thickness of the stack by doubling the number of samples in the stack results in no change in the measured reflectance factor.

As used herein, the term "black backing" refers to a backing having a reflectance factor which does not differ from its nominal value by more than 0.2 percent at all wavelengths. The black backing may be a black trap as provided in the Spectrophotometer Datacolor 800V.

The following method can be used to measure the reflectance factor of the first portion of the bridging element. The method is based on ISO2471:2008.

First, it is necessary to prepare a plurality of samples of the first portion of bridging elements in order to form a stack of samples. Each sample should be identical. When handling the samples it is important to minimize damage or deterioration of the sample. Laying the samples flat in a large envelope or between two large pieces of cardboard may protect the samples from contamination in transit. Exposure of the samples to direct sunlight, extreme temperatures and extreme humidity should also be avoided.

As described above, the number of samples in the stack should be such that doubling the number does not alter the reflectance factor. Each sample first portion should be separate or separated from the aerosol-generating article and laid out flat and single sided (i.e. not folded over on itself). Each sample should be the same way up, with the side of the sample that would form the outer surface of an assembled aerosol-generating article facing up.

The intrinsic luminous reflectance factor of the stack is measured from the top side of the stack. This should be measured to the nearest 0.01 percent.

A first sample is then removed from the top of the stack of samples and, with a black backing behind the first sample, the luminance factor of the sample is measured. The same spot on the sample should be measured when the sample is part of the stack and when the sample is removed from the stack.

The reflectance factor of the sample of the first portion of the bridging element is calculated as the luminous reflectance factor of the sample divided by the intrinsic luminous reflectance factor multiplied by 100.

The reflectance factor of samples in the stack of samples can be measured. In this case, the first sample is moved to the bottom of the stack and the measurements of luminous reflectance factor and intrinsic luminous reflectance factor are repeated for the second sample and for any subsequent samples. Preferably, this process is repeated five times and a mean reflectance factor calculated.

ISO2471:2008 describes that the stack is turned upside down and the measurements repeated for the bottom side. However, this is not appropriate or necessary when measuring the reflectance factor of the bridging element. As described above, the portion of the bridging element having a reflectance factor of greater than 85 percent advantageously reduces the visibility of the cavity when the aerosol-generating article is viewed from the outside and in normal lighting conditions. Therefore, measurements of the reflectance factor of the inside surface are not important.

The bridging element comprises at least one wrapper. In cases where the bridging element comprises two or more wrappers, each individual sample of the first portion of the bridging element in the stack comprises two or more wrappers. The plurality of wrappers should be treated as a single sample. For example, if the bridging element comprise three wrappers, a single sample also comprises three wrappers. Therefore, a stack of 10 bridging elements may comprise, for example, 20 wrappers. The measurement of the luminous reflectance factor should be made of the plurality of wrappers together, not of the wrappers individually.

In some cases, the reflectance factor of the first portion may be determined by performing a visual comparison between a reference sample having a known reflectance factor and the first portion, rather than directly measuring the reflectance factor of the first portion. For example, this method may be useful when the bridging element is small. Alternatively or additionally, a visual comparison may allow for the reflectance factor to be determined or estimated relatively quickly. In a visual comparison method, a reference sample of known reflectance factor is provided. For example, the reference sample may have a standard or previously measured reflectance factor.

The visual comparison may comprise placing both the first portion of the bridging element and the reference sample on a black backing and comparing the reflectance factor in uniform light. The reference sample may have similar properties to the first portion. For example, the colour of the reference sample and the first portion may be similar or the same. In particular, both the reference sample and the first portion may be white. In the visual comparison, the component having lower reflectance factor will appear darker. Therefore, provided the first portion of the bridging element appears the same or less dark than the reference sample, it may be determined that the first portion of the bridging element has a reflectance factor of at least the reflectance factor of the reference sample. The visual comparison may be confirmed by a plurality of technicians in order to accurately verify the reflectance factor of the first portion. A reference sample having a reflectance factor of at least 85 percent may be used.

As used herein, the terms 'upstream' and 'downstream' are used to describe the relative positions of elements, or portions of elements, of the aerosol-generating article in relation to the direction in which a user draws on the aerosol-generating article during use thereof.

As used herein, the term "inner surface of the bridging element" is used to describe the surface of the bridging element that faces towards the inside of aerosol-generating article.

The upstream end of the cavity may be delimited by the rod. The downstream end of the cavity may be delimited by the filter. The cavity may have a length of at least 1 millimetre. Such a length of cavity can reduce the transfer of heat produced upstream of the cavity to the filter, whether such heat is produced by the ignited aerosol-generating substrate or by the heater of an aerosol-generating device. The cavity may reduce heat transfer to such that excessive heating of the filter is avoided. The cavity may have a length of between 1 millimetre and 7 millimetres. Preferably, the cavity may have a length of between 2 millimetres and 5 millimetres. Even more preferably, the cavity may have a length of 3 millimetres.

The bridging element may have a length of greater than 25 millimetres. Such a bridging element may be sufficiently long to span the cavity and to circumscribe both the rod and filter. The bridging element may circumscribe the filter along the entire length of the filter. The bridging element may have a length of between 25 millimetres and 36 millimetres.

The first portion of the bridging element may extend along the length of the bridging element by a distance of at least 1.2 times the length of the cavity. The first portion of the bridging element may extend along the length of the bridging element by a distance of at least 1.5 times the length of the cavity. There may be some variability in the position of the first portion of the bridging element with respect to the cavity. This variability may result from manufacturing tolerances. Having the first portion of the bridging element extend along a length of the bridging element by a distance of at least 1.2 or 1.5 times the length of the cavity can help to account for this variability. The inner surface of the first wrapper partially delimits the cavity regardless of the position of the first portion relative to the cavity.

The first portion of the bridging element may extend a distance of between 4 millimetres and 10 millimetres along the length of the bridging element.

The filter may be circumscribed by the first portion of the bridging element. In other words, the first portion of the bridging element extends beyond the cavity, along the length of the aerosol-generating article, to circumscribe the filter. The first portion of the bridging element may extend along at least 1 millimetre of the length of the filter.

The rod may be circumscribed by the first portion of the bridging element. In other words, the first portion of the bridging element may extend beyond the cavity, along the length of the aerosol-generating article, to circumscribe the rod. The first portion of the bridging element may extend along at least 2 millimetres of the length of the rod. The first portion of the bridging element may extend along between 2 millimetres and 7 millimetres of the length of the rod. The first portion of the bridging element may extend along the entire length of the rod.

The first wrapper may comprise at least one of a cellulose based material, paper, cardboard, reconstituted tobacco or a cellulose based film. The first wrapper may be a tipping paper.

The bridging element may comprise a single wrapper. In other words, the first wrapper may be the only wrapper forming the bridging element.

Alternatively, the bridging element may comprise a second wrapper circumscribing the first wrapper. The reflectance factor of the first portion of the bridging may be a combination of the reflectance factor of both the first wrapper and the second wrapper. By providing two wrappers, the reflectance factor of the first wrapper as part of the first portion can be much lower than 85 percent.

The second wrapper may comprise at least one of a cellulose based material, paper, cardboard, reconstituted tobacco or a cellulose based film. The second wrapper may be a tipping paper.

The inner surface of the first wrapper in the first portion of the bridging element may extend circumferentially around the cavity by a distance of greater than 5 millimetres. The inner surface of the first wrapper in the first portion of the bridging element may extend circumferentially around the cavity by a distance of greater than 10 millimetres. The inner surface of the first wrapper in the first portion of the bridging element may extend circumferentially around the cavity by a distance of greater than 15 millimetres. Preferably, the inner surface of the first wrapper in the first portion of the bridging element may extend circumferentially around the entire circumference of the cavity. Similarly, the first portion of the bridging element may extend circumferentially around the cavity by a distance of greater than 5 millimeters, greater than 10 millimeters or greater than 15 millimeters. Preferably, the first portion of the bridging element may extend around the entire circumference of the cavity.

The inner surface of the first wrapper in the first portion of the bridging element may be curved to define an arc subtending an angle of greater than 45 degrees. The inner surface of the first wrapper in the first portion of the bridging element may be curved to define an arc subtending an angle of greater than 90 degrees. The inner surface of the first wrapper in the first portion of the bridging element may be curved to define an arc subtending an angle of greater than 180 degrees. The inner surface of the first wrapper in the first portion of the bridging element may be curved to define an arc subtending an angle of greater than 270 degrees. Similarly, the first portion of the bridging element may be curved to define an arc subtending an angle of greater than 45 degrees, greater than 90 degrees, greater than 180 degrees or greater than 270 degrees.

The inner surface of the first wrapper of the first portion of the bridging element may have a surface area of greater than 25 millimetres squared. The inner surface of the first wrapper in the first portion of the bridging element may have a surface area of greater than 50 millimetres squared. Similarly, the first portion of the bridging element may have a surface area of greater than 25 millimeters squared or greater than 50 millimeters squared.

The inner surface of the first wrapper in the first portion of the bridging element may comprise a coating. The coating may contribute to increasing the reflectance factor of the bridging element in the first portion of the bridging element. The provision of a coating may be particularly preferable when the bridging element comprises a single wrapper. In such embodiments, the reflectance factor of the first portion of the single wrapper may only be high enough to obscure the cavity when the single wrapper comprises a coating.

By providing the coating on the inner surface, features such as texture on the outer surface of the first portion of the bridging element is unaffected by the coating. In embodiments where the bridging element comprises at least a second portion, different to the first portion, this may advantageously ensure a continuous appearance of the bridging element.

The coating may be printed on to the inner surface of the first wrapper. The coating may be printed on to the inner surface of the first wrapper using a rotogravure printing technique.

The coverage density of the coating may be between 1 gram per centimetre squared and 5 gram per centimetre squared. A coating of such a coating density may advantageously contribute sufficiently to the reflectance factor of the first portion such that the cavity is not discernible through the first portion comprising the coating. The coating may have a thickness of between 1 and 5 microns.

The coating may comprise an opaque pigment. As used herein, the term 'opaque pigment' is used to describe a pigment that is impenetrable to light. Light incident on the opaque pigment may instead be absorbed or reflected by the opaque pigment. As the opaque pigment is impenetrable to light, the provision of opaque pigments in the coating reduces the amount of light passing through the first portion of the wrapper having the coating. Therefore, the provision of a coating comprising opaque pigments may advantageously increase the reflectance factor of the first portion of the bridging element.

The coating may comprise a white pigment. Light incident on white pigments is reflected. Light reflected by the white pigment does not pass through the white pigment. The white pigment may comprise at least one of titanium dioxide, calcium hydroxide or zinc oxide.

The coating may comprise a black pigment. Light incident on the black pigment may advantageously be absorbed. Light absorbed by the black pigment does not pass through the black pigment. The black pigment may comprise at least one of vegetal black carbon or black iron oxide.

The coating may comprise both white and black pigments. The colour of the first portion may depend on the ratio of white pigments to black pigments in the coating. For example, a higher percentage of black pigments will result in the coating having a darker appearance and so will darken the colour of first portion of the bridging element. The coating may comprise between 10 percent and 30 percent black pigments by weight. The coating may comprise between 70 percent and 90 percent white pigments by weight. Preferably, the coating may comprise white and black pigments in a ratio of 80 percent white pigments to 20 percent black pigments. In embodiments where the bridging element comprises at least a second portion, different to the first portion, this may advantageously ensure a continuous appearance of the bridging element.

The coating may comprise nitrocellulose. The coating may comprise a solvent such as ethanol or ethyl acetate.

In at least one example, there is provided an aerosol-generating article comprising: a rod comprising an aerosol-generating substrate; a filter in axial alignment with the rod; a bridging element comprising a first wrapper, the first wrapper circumscribing the rod and the filter and securing the filter to the rod; and a cavity located between the rod and the filter, the cavity being partially delimited by the inner surface of the first wrapper in a first portion of the bridging element, wherein the inner surface of the first wrapper in the first portion of the bridging element comprises a coating. The coating may have any of the features referred to in the preceding passages.

The rod comprising an aerosol-generating substrate may further comprise a wrapper circumscribing the aerosol-generating substrate.

As used herein, the term 'aerosol-generating substrate' is used to describe a substrate capable of releasing upon heating or burning volatile compounds, which can form an aerosol. The aerosol generated from aerosol-generating substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

The aerosol-generating article may be of the type that is consumed by ignition of the rod and the aerosol-generating substrate. The aerosol-generating article may be a smoking article. The aerosol-generating article may be a cigarette. In aerosol-generating articles consumed by ignition, the aerosol-generating substrate may comprise any suitable tobacco material. For example, the tobacco material may comprise tobacco cut filler.

The aerosol-generating article may be of the type in which an aerosol is generated by heating, rather than burning, the aerosol-generating substrate. During consumption, volatile compounds are released from the aerosol-generating substrate by heat transfer from a heat source and entrained in air drawn through the aerosol-generating article. As the released compounds cool, they condense to form an aerosol that is inhaled by the consumer. The heat source may be provided by an aerosol-generating device having a heater for heating the aerosol-generating article. The aerosol-generating article may be heated aerosol-generating article.

As used herein, the term 'aerosol-generating device' is used to describe a device that interacts with an aerosol-generating substrate of an aerosol-generating article to generate an aerosol. Preferably, the aerosol-generating device is a smoking device that interacts with the aerosol-generating substrate of an aerosol-generating article to generate an aerosol that is directly inhalable into a user's lungs thorough the user's mouth.

In aerosol-generating articles consumed by heating of the aerosol-generating substrate, the aerosol-generating substrate is preferably a solid aerosol-generating substrate. The aerosol-generating substrate may comprise both solid and liquid components. The aerosol-generating substrate may comprise tobacco material.

Alternatively or in addition, the aerosol-generating substrate may comprise a non-tobacco containing aerosol-generating material.

If the aerosol-generating substrate is a solid aerosol-generating substrate, the solid aerosol-generating substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-generating substrate may contain tobacco or non-tobacco volatile flavour compounds, which are released upon heating of the solid aerosol-generating substrate. The solid aerosol-generating substrate may also contain one or more capsules that, for example, include additional tobacco volatile flavour compounds or non-tobacco volatile flavour compounds and such capsules may melt during heating of the solid aerosol-generating substrate.

Optionally, the solid aerosol-generating substrate may be provided on or embedded in a thermally stable carrier. The carrier may take the form of powder, granules, pellets, shreds, strands, strips or sheets. The solid aerosol-generating substrate may be deposited on the surface of the carrier in the form of, for example, a sheet, foam, gel or slurry. The solid aerosol-generating substrate may be deposited on the entire surface of the carrier, or alternatively, may be deposited in a pattern in order to provide a non-uniform flavour delivery during use.

In a preferred embodiment, the aerosol-generating substrate comprises homogenised tobacco material.

As used herein, the term 'homogenised tobacco material' denotes a material formed by agglomerating particulate tobacco.

Preferably, the aerosol-generating substrate comprises a gathered sheet of homogenised tobacco material.

As used herein, the term 'sheet' denotes a laminar element having a width and length substantially greater than the thickness thereof.

As used herein, the term 'gathered' is used to describe a sheet that is convoluted, folded, or otherwise compressed or constricted substantially transversely to the longitudinal axis of the aerosol-generating article.

Use of an aerosol-generating substrate comprising a gathered sheet of homogenised tobacco material advantageously significantly reduces the risk of 'loose ends' compared to an aerosol-generating substrate comprising shreds of tobacco material, that is the loss of shreds of tobacco material from the ends of the rod. Loose ends may disadvantageously lead to the need for more frequent cleaning of an aerosol-generating device for use with the aerosol-generating article and manufacturing equipment.

The filter may delimit one side of the cavity. The filter may comprise a segment of filtration material. The filter may also comprise a filter wrapper circumscribing the segment of filtration material. The segment of filtration material may extend along the whole length of the filter. The filtration material may comprise at least one of cellulose acetate, cellulose, reconstituted cellulose, polylactic acid, polyvinyl alcohol, nylon, polyhydroxybutyrate, thermoplastic material, starch, non-woven materials, longitudinally orientate fibres and randomly orientated fibres, crepe, PLA fibres and combinations thereof.

The filter of heated aerosol-generating articles may comprise components in addition to the segment of filtration material. Each of these components may be assembled within the filter wrapper. Each of the components may be in axial alignment.

The filter of a heated aerosol-generating article may comprise an aerosol-cooling element located upstream of the segment of filtration material. The cavity of the aerosol-generating article may be located immediately upstream of the aerosol-cooling element.

The filter of a heated aerosol-generating article may comprise an aerosol-cooling element located upstream of the segment of filtration material. The cavity of the aerosol-generating article may be located immediately upstream of the aerosol-cooling element.

As used herein, the term 'aerosol-cooling element' is used to describe an element having a large surface area and a low resistance to draw. In use, an aerosol formed by volatile compounds released from the aerosol-generating substrate passes over and is cooled by the aerosol-cooling element before being inhaled by a user.

The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length.

In the disclosure there is also provided a container comprising a plurality of aerosol-generating articles, wherein at least 50 percent of the aerosol-generating articles comprise a rod comprising an aerosol-generating substrate; a filter in axial alignment with the rod; a bridging element comprising a first wrapper, the first wrapper circumscribing the rod and the filter and securing the filter to the rod; and a cavity located between the rod and the filter, the cavity being partially delimited by the inner surface of the first wrapper in a first portion of the bridging element, wherein the first portion of the bridging element has a reflectance factor of 85 percent or higher. Said aerosol-generating article may have any of the features described above. Said aerosol-generating articles may make up at least 60 percent of the aerosol-generating articles, at least 70 percent, at least 80 percent, or at least 90 percent of the plurality of aerosol-generating articles.

The container may comprise at least 5 aerosol-generating articles. The container may comprise at least 10 aerosol-generating articles.

The container may be a box. The container may be a lidded box. The lid may be a hinged lid.

In the disclosure there is also provided a method of manufacturing an aerosol-generating article. The method may comprise providing a rod. The rod may comprise an aerosol-generating substrate. The method may also comprise providing a filter. The method may also comprise providing a bridging element. The bridging element may comprise a first wrapper. The method also may comprise securing the filter to the rod using the bridging element such that the first wrapper circumscribes the rod and the filter in a spaced-apart relationship to form a cavity between the rod and the filter. The cavity may be partially delimited by the inner surface of the first wrapper in a first portion of the bridging element. The first portion of the bridging element may have a reflectance factor of 85 percent or higher.

In one example, the method of manufacturing an aerosol-generating article comprises: providing a rod comprising an aerosol-generating substrate; providing a filter; providing a bridging element comprising a first wrapper; and securing the filter to the rod using the bridging element such that the first wrapper circumscribes the rod and the filter in a spaced-apart relationship to form a cavity between the rod and the filter, the cavity being partially delimited by the inner surface of the first wrapper in a first portion of the bridging element, wherein the first portion of the bridging element has a reflectance factor of 85 percent or higher.

The step of securing the filter to the rod may comprise wrapping the bridging element around the rod. The step of securing the filter to the rod may comprise wrapping the bridging element around the filter. The step of securing the filter to the rod may comprise permanently securing the filter to the rod. The step of securing the filter to the rod may comprise gluing the inner surface of the wrapper to the rod. The step of securing the filter to the rod may comprise gluing the inner surface of the wrapper to the filter. The inner surface of the first wrapper of the bridging element may comprise adhesive. The adhesive may permanently secure the bridging element to the rod. The adhesive may permanently secure the bridging element to the filter.

Below, there is provided a non-exhaustive list of non-limiting examples. Any one or more of the features of these examples may be combined with any one or more features of another example, embodiment, or aspect described herein.

EX1. An aerosol-generating article comprising:
- a rod comprising an aerosol-generating substrate;
- a filter in axial alignment with the rod;
- a bridging element comprising a first wrapper, the first wrapper circumscribing the rod and the filter and securing the filter to the rod; and
- a cavity located between the rod and the filter, the cavity being partially delimited by the inner surface of the first wrapper in a first portion of the bridging element, wherein the first portion of the bridging element has a reflectance factor of 85 percent or higher.

EX2. An aerosol-generating article according to example EX1, wherein the portion of the bridging element delimiting the cavity has a reflectance factor of 90 percent or higher.

EX3. An aerosol-generating article according to example EX1 or EX2, wherein the portion of the bridging element delimiting the cavity has a reflectance factor of 95 percent or higher.

EX4. An aerosol-generating article according to any one of examples EX1 to EX3, wherein the cavity has a length of at least 1 millimetre.

EX5. An aerosol-generating article according to any one of examples EX1 to EX4, wherein the cavity has a length of between 1 millimetre and 7 millimetres.

EX6. An aerosol-generating article according to any one of examples EX1 to EX5, wherein the cavity has a length of between 2 millimetres and 5 millimetres.

EX7. An aerosol-generating article according to any one of examples EX1 to EX6, wherein the cavity has a length of 3 millimetres.

EX8. An aerosol-generating article according to any one of examples EX1 to EX7, wherein the bridging element has a length of greater than 25 millimetres.

EX9. An aerosol-generating article according to any one of examples EX1 to EX8, wherein the bridging element has a length of between 25 millimetres and 36 millimetres.

EX10. An aerosol-generating article according to any one of examples EX1 to EX9, wherein the first portion of the first wrapper of the bridging element extends along the length of the bridging element by a distance of 1.2 times the length of the cavity.

EX11. An aerosol-generating article according to any one of examples EX1 to EX10, wherein the first portion of first wrapper of the bridging element extends a distance of between 4 millimetres and 10 millimetres along the length of the bridging element.

EX12. An aerosol-generating article according to any one of examples EX1 to EX11, wherein the filter is circumscribed by the first portion of the bridging element.

EX13. An aerosol-generating article according to any one of examples EX1 to EX12, wherein the first portion of the bridging element extends along at least 1 millimetre of the length of the filter.

EX14. An aerosol-generating article according to any one of examples EX1 to EX13, wherein the first portion of the bridging element extends along the entire length of the filter.

EX15. An aerosol-generating article according to any one of examples EX1 to EX14, wherein the rod is circumscribed by the first portion of the bridging element.

EX16. An aerosol-generating article according to any one of examples EX1 to EX15, wherein the first portion of the bridging element extends along at least 2 millimetres of the length of the rod.

EX17. An aerosol-generating article according to any one of examples EX1 to EX16, wherein the first portion of the bridging element extends along between 2 millimetres and 7 millimetres of the length of the rod.

EX18. An aerosol-generating article according to any one of examples EX1 to EX17, wherein the first portion of the bridging element extends along the entire length of the rod.

EX19. An aerosol-generating article according to any one of examples EX1 to EX18, wherein the first wrapper comprises at least one of a cellulose based material, paper, cardboard, reconstituted tobacco or a cellulose based film.

EX20. An aerosol-generating article according to any one of examples EX1 to EX19, wherein the bridging element comprises a single wrapper.

EX21. An aerosol-generating article according to any one of examples EX1 to EX20, wherein the bridging element comprises a second wrapper circumscribing the first wrapper.

EX22. An aerosol-generating article according to any one of examples EX1 to EX21, wherein the second wrapper comprises at least one of a cellulose based material, paper, cardboard, reconstituted tobacco or a cellulose based film.

EX23. An aerosol-generating article according to any one of examples EX1 to EX22, wherein the inner surface of the first wrapper in the first portion of the bridging element extends circumferentially around the cavity by a distance of greater than 5 millimetres.

EX24. An aerosol-generating article according to any one of examples EX1 to EX23, wherein the inner surface of the first wrapper in the first portion of the bridging element extends circumferentially around the cavity by a distance of greater than 10 millimetres.

EX25. An aerosol-generating article according to any one of examples EX1 to EX24, wherein the inner surface of the first wrapper in the first portion of the bridging element extends circumferentially around the cavity by a distance of greater than 15 millimetres.

EX26. An aerosol-generating article according to any one of examples EX1 to EX25, wherein the inner surface of the first wrapper in the first portion of the bridging element extends around the entire circumference of the cavity.

EX27. An aerosol-generating article according to any one of examples EX1 to EX26, wherein the inner surface of the first wrapper of the first portion of the bridging element is curved to define an arc subtending an angle of greater than 45 degrees.

EX28. An aerosol-generating article according to any one of examples EX1 to EX27, wherein the inner surface of the first wrapper of the first portion of the bridging element is curved to define an arc subtending an angle of greater than 90 degrees.

EX29. An aerosol-generating article according to any one of examples EX1 to EX28, wherein the inner surface of the first wrapper of the first portion of the bridging element is curved to define an arc subtending an angle of greater than 180 degrees.

EX30. An aerosol-generating article according to any one of examples EX1 to EX29, wherein the inner surface of the first wrapper of the first portion of the bridging element is curved to define an arc subtending an angle of greater than 270 degrees.

EX31. An aerosol-generating article according to any one of examples EX1 to EX30, wherein the inner surface of the first wrapper of the first portion of the bridging element has a surface area of greater than 25 millimetres squared.

EX32. An aerosol-generating article according to any one of examples EX1 to EX31, wherein the first portion of the bridging element extends circumferentially around the cavity by a distance of greater than 5 millimetres.

EX33. An aerosol-generating article according to any one of examples EX1 to EX32, wherein the first portion of the bridging element extends circumferentially around the cavity by a distance of greater than 10 millimetres.

EX34. An aerosol-generating article according to any one of examples EX1 to EX33, wherein the first portion of the bridging element extends circumferentially around the cavity by a distance of greater than 15 millimetres.

EX35. An aerosol-generating article according to any one of examples EX1 to EX34, wherein the first portion of the bridging element extends around the entire circumference of the cavity.

EX36. An aerosol-generating article according to any one of examples EX1 to EX35, wherein the first portion of the bridging element is curved to define an arc subtending an angle of greater than 45 degrees.

EX37. An aerosol-generating article according to any one of examples EX1 to EX36, wherein the first portion of the bridging element is curved to define an arc subtending an angle of greater than 90 degrees.

EX38. An aerosol-generating article according to any one of examples EX1 to EX37, wherein the first portion of the bridging element is curved to define an arc subtending an angle of greater than 180 degrees.

EX39. An aerosol-generating article according to any one of examples EX1 to EX38, wherein the first portion of the bridging element is curved to define an arc subtending an angle of greater than 270 degrees.

EX40. An aerosol-generating article according to any one of examples EX1 to EX39, wherein the first portion of the bridging element has a surface area of greater than 25 millimetres squared.

EX41. An aerosol-generating article according to any one of examples EX1 to EX40, wherein the inner surface of the first wrapper in the first portion of the bridging element may comprise a coating.

EX42. An aerosol-generating article according to example EX41, wherein the coverage density of the coating is between 1 gram per centimetre squared and 5 gram per centimetre squared.

EX43. An aerosol-generating article according to example EX41 or EX42, wherein the coating has a thickness of between 1 and 5 microns.

EX44. An aerosol-generating article according to any one of examples EX41 to EX43, wherein the coating comprises an opaque pigment.

EX45. An aerosol-generating article according to any one of examples EX41 to EX44, wherein the coating comprises a white pigment.

EX46. An aerosol-generating article according to example EX45, wherein the white pigment comprises at least one of titanium dioxide, calcium hydroxide or zinc oxide.

EX47. An aerosol-generating article according to any one of examples EX41 to EX46, wherein the coating comprises a black pigment.

EX48. An aerosol-generating article according to example EX47, wherein the black pigment comprises at least one of vegetal black carbon or black iron oxide.

EX49. An aerosol-generating article according to any one of examples EX41 to EX48, wherein the coating comprises between 10 percent and 30 percent black pigments by weight.

EX50. An aerosol-generating article according to any one of examples EX41 to EX49, wherein the coating comprises between 70 percent and 90 percent white pigments by weight.

EX51. An aerosol-generating article according to any one of examples EX41 to EX50, wherein the coating comprises white and black pigments in a ratio of 80 percent white pigments to 20 percent black pigments.

EX52. An aerosol-generating article according to any one of examples EX41 to EX51, wherein the coating comprises nitrocellulose.

EX53. An aerosol-generating article according to any one of examples EX41 to EX52, wherein the coating comprises a solvent such as ethanol or ethyl acetate.

EX54. A container comprising a plurality of aerosol-generating articles, at least half of the plurality of aerosol-generating article being aerosol-generating articles according to any one of examples EX1 to EX53.

EX55. A container according to example EX54 comprises at least 5 aerosol-generating articles.

EX56. A container according to example EX54 or EX55, wherein the container comprises at least 10 aerosol-generating articles.

EX57. A container according to any one of examples EX54 to EX56, wherein at least 90 percent of the aerosol-generating article may be aerosol-generating articles according to examples EX1 to EX43.

EX58. A container according to any one of examples EX54 to EX57, wherein the container is a box.

EX59. A container according to any one of examples EX54 to EX58, wherein the container is a lidded box.

EX60. A container according to example EX59, wherein the lid may is a hinged lid.

EX61. A method of manufacturing an aerosol-generating article comprising:

providing a rod comprising an aerosol-generating substrate;

providing a filter;

providing a bridging element comprising a first wrapper; and permanently securing the filter to the rod using the bridging element such that the first wrapper circumscribes the rod and the filter in a spaced-apart relationship to form a cavity between the rod and the filter, the cavity being partially delimited by the inner surface of the first wrapper in a first portion of the bridging element, wherein the first portion of the bridging element has a reflectance factor of 85 percent or higher.

EX62. A method of manufacturing an aerosol-generating article according to example EX61, wherein the step of permanently securing the filter to the rod comprises wrapping the bridging element around the rod.

EX63. A method of manufacturing an aerosol-generating article according to example EX61 or EX62, wherein the step of permanently securing the filter to the rod comprises wrapping the bridging element around the filter.

EX64. A method of manufacturing an aerosol-generating article according to any one of examples EX61 to EX63, wherein the step of securing the filter to the rod comprises permanently securing the filter to the rod.

EX65. A method of manufacturing an aerosol-generating article according to any one of examples EX61 to EX64, wherein the step of securing the filter to the rod comprises gluing the inner surface of the wrapper to the rod.

EX66. A method of manufacturing an aerosol-generating article according to any one of examples EX61 to EX65, wherein the step of securing the filter to the rod comprises gluing the inner surface of the wrapper to the filter.

EX67. A method of manufacturing an aerosol-generating article according to any one of examples EX61 to EX66, wherein the inner surface of the first wrapper of the bridging element comprises adhesive.

EX68. A method of manufacturing an aerosol-generating article according to example EX67, wherein the adhesive permanently secures the bridging element to the rod.

EX69. A method of manufacturing an aerosol-generating article according to example EX67 or EX68, wherein the adhesive permanently secures the bridging element to the filter.

Features described in relation to one example or embodiment may also be applicable to other examples and embodiments. In particular, features of the rod, filter, bridging element and cavity described in relation to the aerosol-generating article may also be applicable to the rod, filter, bridging element and cavity described in relation to the method of manufacturing the aerosol-generating article.

Examples will now be further described with reference to the figures in which.

Figure 4:
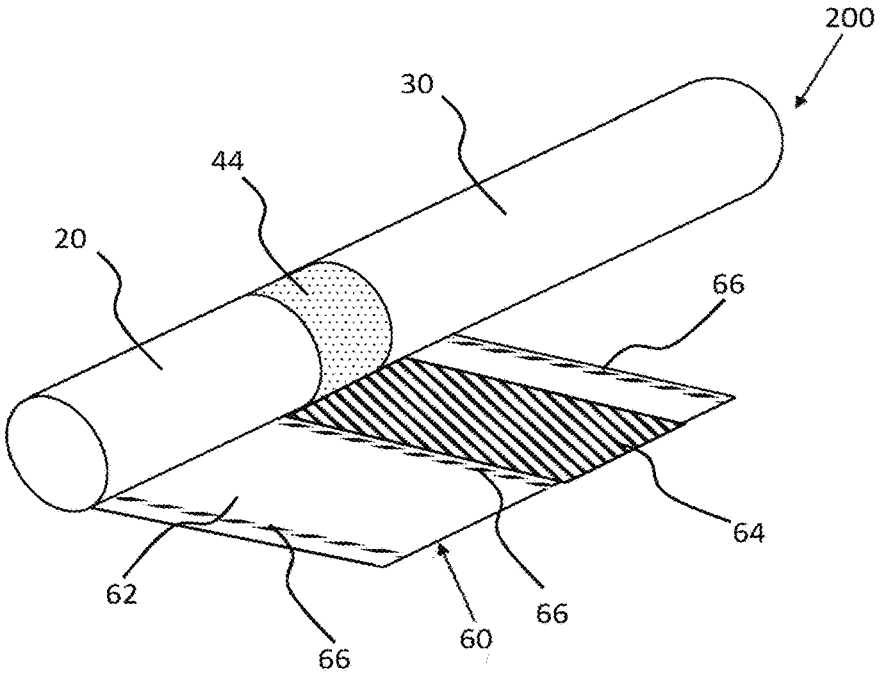
Figure 5:
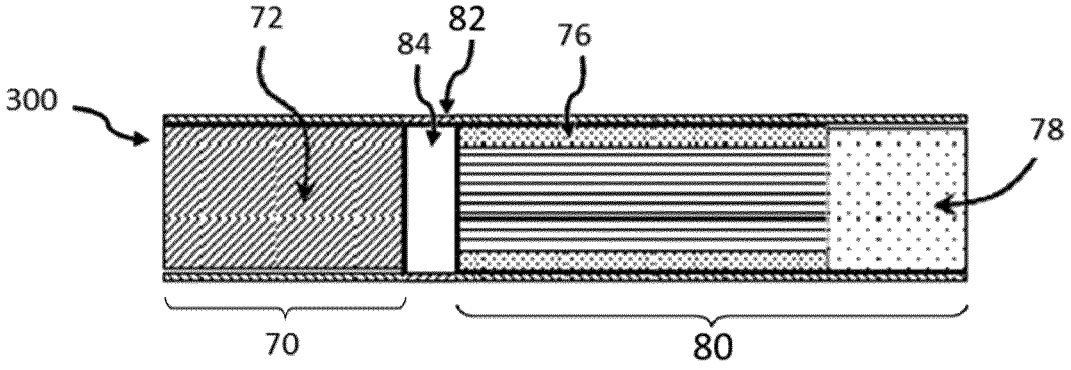

FIG. 4 shows a bridging element as part of an aerosol-generating article, in accordance with the disclosure, but with the bridging element unwrapped to show the inner surface of the bridging element with respect to the other features of the aerosol-generating article; and FIG. 5 shows an aerosol-generating article 300 in accordance with the invention, configured to generate an aerosol by heating rather than burning the aerosol-generating substrate.

Figure 1:
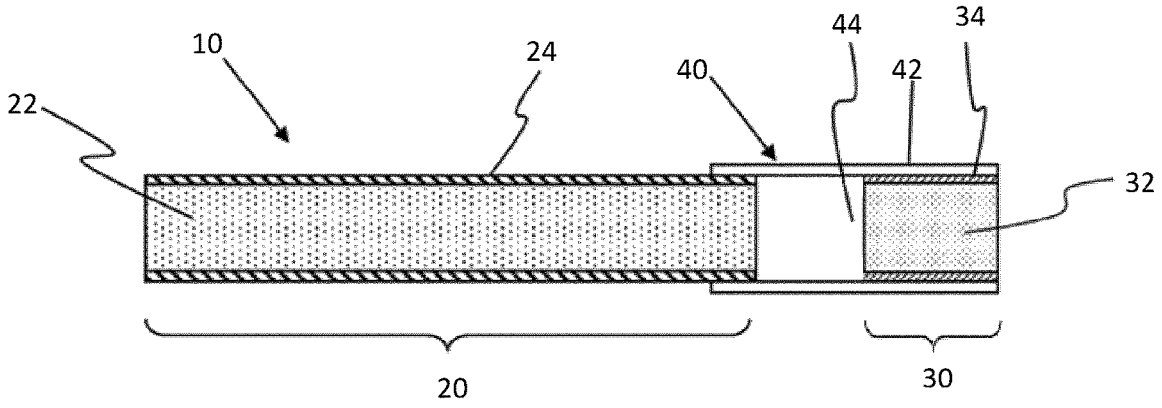
FIG. 1 shows an aerosol-generating article in accordance with the disclosure, the aerosol-generating article comprising a bridging element comprising a single wrapper.

FIG. 1 shows an aerosol-generating article 10 having an upstream end and a downstream end and comprising a tobacco rod 20 which is attached at its downstream end to an axially aligned filter 30. Aerosol-generating article 10 is a cigarette which is configured to be consumed by ignition of the tobacco rod 20.

The tobacco rod 20 comprises a charge of cut filler 22 that is circumscribed by a tobacco rod wrapper 24. The filter 30 comprises a single segment of cellulose acetate tow 32 circumscribed by a filter wrapper 34.

The aerosol-generating article 10 also comprises a bridging element 40 comprising a single wrapper 42. The single wrapper 42 circumscribes the tobacco rod 20 and the filter 30. The single wrapper comprises adhesive (not shown in FIG. 1) to permanently secure the filter 30 to the tobacco rod 20. The bridging element 40 has a reflectance factor of 85 percent or higher.

A cavity 44 is located between the tobacco rod 20 and the filter 30. The cavity 44 is delimited by the ends of the tobacco rod 20 and the filter 30 and by the inner surface of the single wrapper 42 of the bridging element 40. The inner surface of the single wrapper extends circumferentially around the cavity 44, extending around the complete circumference of the cavity 44. The cavity 44 being partially delimited by the single wrapper 42 of the bridging element 40 having a reflectance of 85 percent or higher results in the cavity not being visibly discernible through the bridging element when the aerosol-generating article is viewed from the outside and in normal lighting conditions. The cavity 44 has a length of 3 millimeters. In other words, the separation between the tobacco rod 20 and the filter 30 is 3 millimeters.

Figure 2:
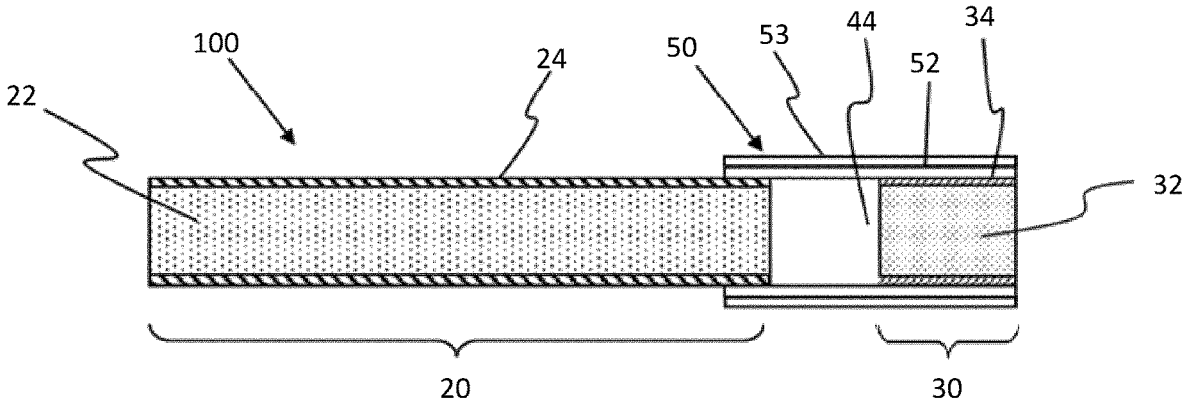
FIG. 2 shows another aerosol-generating article in accordance with the disclosure, the aerosol-generating article comprising a bridging element comprising a first wrapper and a second wrapper.

FIG. 2 shows an aerosol-generating article 100. The aerosol-generating article 100 comprises a bridging element 50 comprising a first wrapper 52 and a second wrapper 53. In all other respects, the aerosol-generating article 100 is the same as the aerosol-generating article 10 of FIG. 1.

The first wrapper 52 of the bridging element 50 circumscribes the tobacco rod 20 and the filter 30. The first wrapper 52 comprises adhesive (not shown in FIG. 2) to permanently secure the filter 30 to the tobacco rod 20. The second wrapper 53 circumscribes the first wrapper 52.

The bridging element 50 has a reflectance factor of 85 percent or higher. Both the first wrapper 52 and the second wrapper 53 contribute to the reflectance factor of bridging element 50. The cavity located between the tobacco rod 20 and the filter 30 is delimited by the ends of the tobacco rod 20 and the filter 30 and by the inner surface of the first wrapper 52.

Figure 3:
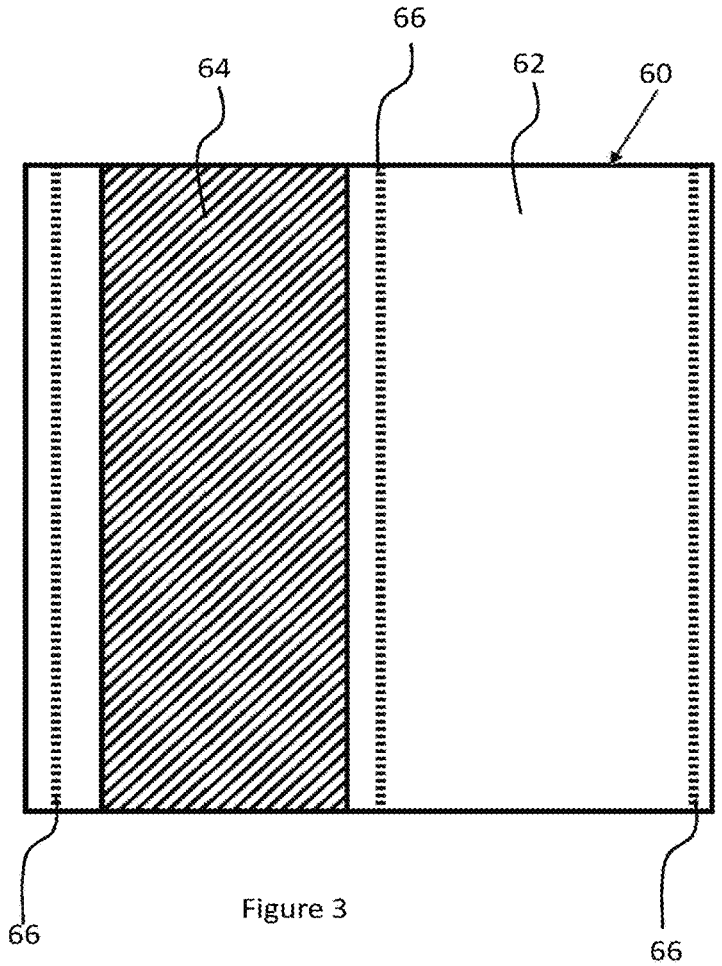
FIG. 3 shows the inner surface of a bridging element in an unwrapped state.

It is not necessary for the entire length of each bridging element 40, 50 of the aerosol-generating articles shown respectively in FIGS. 1 and 2 to have a reflectance factor of 85 percent higher. FIG. 3 shows an example of a bridging element where a portion of the bridging element having a reflectance of 85 percent or higher does not extend along the full length of the bridging element.

FIG. 3 shows a bridging element 60 comprising a single wrapper 62. The bridging element 60 is shown separately to any aerosol-generating article and from the perspective of the inner surface of the single wrapper 62. The bridging element 60 comprises a first portion 64 having a reflectance factor of 85 percent or higher.

The single wrapper 62 comprises a coating on the inner surface which demarks the first portion 64. The coating is printed on to the inner surface of the single wrapper with a coverage density of between 1 and 5 grams per centimetre squared. The coating comprises opaque pigments. The opaque pigments comprise white and black pigments in a ratio of 80 percent white pigments to 20 percent black pigments. The coating also comprises nitrocellulose and an ethanol or ethyl acetate solvent. The coating contributes to the reflectance factor of the first portion 64 being 85 percent or higher.

The single wrapper 62 also comprises lines of adhesive 66. These lines of adhesive 66 are used to permanently secure the bridging element 60 to a tobacco rod 20 and filter 30.

FIG. 4 shows the bridging element 60 as part of an aerosol-generating article 200 but unwrapped to show the inner surface of the single wrapper 62 with respect to the other features of the aerosol-generating article 200. FIG. 4 shows how the first portion 64, as demarked by the coating on the inner surface of the single wrapper 62, is aligned with cavity so that the cavity 44 is delimited by the first portion 64 when the aerosol-generating article 200 is fully assembled.

The cavity 44 has a length of 3 millimeters. The first portion 64 extends along the length of the single wrapper 62 by a distance of 7 millimetres. Therefore, the first portion extends along the bridging element 60 by a distance, which is greater than the length of the cavity 44. This ensures that cavity 44 is delimited by the first portion 64 of the bridging element 60 along the entire length of the cavity 44, even if manufacturing tolerances cause the bridging element 60 and the cavity 44 to not be centrally aligned. As a result, the first portion 64 of the bridging element 60 circumscribes a portion of the tobacco rod 20 and a portion of the filter 30. In a properly aligned aerosol-generating article, the first portion 64 of the bridging element 60 extends a distance of 2 millimetres along the length of the filter and 2 millimetre along the length of the rod.

FIG. 5 shows an aerosol-generating article 300 configured to generate an aerosol by heating rather than burning the aerosol-generating substrate. The aerosol-generating article 300 comprises a rod 70 at an upstream end. The rod 70 comprises an aerosol-generating substrate 72. The aerosol-generating article 300 also comprises a filter 80 at a downstream end. The filter 80 comprises an aerosol-cooling element 76 and a segment of filtration material 78 downstream of the aerosol-cooling element 76. The filter 80 and rod 70 are in axial alignment with one another and each of the components of the filter 70 are in axial alignment.

The aerosol-generating article 300 also comprises a bridging element 82 comprising a single wrapper. The single wrapper comprises adhesive (not shown in FIG. 5) to permanently secure the filter 80 to the rod 70. The bridging element 82 has a reflectance factor of 85 percent or higher.

A cavity 84 is located between the rod 70 and the filter 80. The cavity 84 is delimited by the ends of the rod 70 and the filter 80 and by the inner surface of the single wrapper of the bridging element 80. The inner surface of the single wrapper extends circumferentially around the cavity 84, extending around the complete circumference of the cavity 84. The cavity 84 being partially delimited by the single wrapper of the bridging element 82 having a reflectance of 85 percent or higher results in the cavity not being visibly discernible through the bridging element 82 when the aerosol-generating article 300 is viewed from the outside and in normal lighting conditions.

It should be clear to the skilled person that the bridging element 40, 50 and 60, as described above in relation to FIGS. 1, 2 and 4, can be applied to the heated aerosol-generating article of FIG. 5.

The invention claimed is:

1. An aerosol-generating article comprising:

a rod comprising an aerosol-generating substrate;

a filter in axial alignment with the rod;

a bridging element comprising a first wrapper, the first wrapper circumscribing the rod and the filter and securing the filter to the rod; and a cavity located between the rod and the filter, the cavity being partially delimited by an inner surface of the first wrapper in a first portion of the bridging element, wherein the first portion of the bridging element has a reflectance factor of 85 percent or higher;

wherein the inner surface of the first wrapper in the first portion of the bridging element comprises a coating; and wherein the coating is spaced apart from at least one of an upstream end and a downstream end of the bridging element.

2. The aerosol-generating article according to claim 1, wherein an upstream end of the cavity is delimited by the rod and a downstream end of the cavity is delimited by the filter.

3. The aerosol-generating article according to claim 1, wherein the cavity has a length of at least 1 millimetre.

4. The aerosol-generating article according to claim 1, wherein the first portion of the bridging element extends along the length of the bridging element by a distance of at least 1.2 times the length of the cavity.

5. The aerosol-generating article according to claim 1, wherein the first portion of the bridging element extends a distance of between 4 millimetres and 10 millimetres along the length of the bridging element.

6. The aerosol-generating article according to claim 1, wherein the filter is circumscribed by the first portion of the bridging element.

7. The aerosol-generating article according to claim 6, wherein the first portion of the bridging element extends along at least 1 millimetre of the length of the filter.

8. The aerosol-generating article according to claim 1, wherein the bridging element comprises a single wrapper.

9. The aerosol-generating article according to claim 1, wherein the bridging element comprises a second wrapper circumscribing the first wrapper.

10. The aerosol-generating article according to claim 1, wherein the inner surface of the first wrapper in the first portion of the bridging element extends circumferentially around the cavity by a distance of greater than 5 millimetres.

11. The aerosol-generating article according to claim 1, wherein the inner surface of the first wrapper of the first portion of the bridging element has a surface area of greater than 25 millimetres squared.

12. A container comprising a plurality of aerosol-generating articles, wherein at least 50 percent of the aerosol-generating articles in the container are aerosol-generating articles according to claim 1.

13. A method of manufacturing an aerosol-generating article comprising:

providing a rod comprising an aerosol-generating substrate;

providing a filter;

providing a bridging element comprising a first wrapper; and securing the filter to the rod using the bridging element such that the first wrapper circumscribes the rod and the filter in a spaced-apart relationship to form a cavity between the rod and the filter, the cavity being partially delimited by an inner surface of the first wrapper in a first portion of the bridging element, wherein the first portion of the bridging element has a reflectance factor of 85 percent or higher;

wherein the inner surface of the first wrapper in the first portion of the bridging element comprises a coating; and wherein the coating is spaced apart from at least one of an upstream end and a downstream end of the bridging element.

14. The aerosol-generating article according to claim 1, wherein the coating is spaced apart from the upstream end of the bridging element.

15. The aerosol-generating article according to claim 1, wherein the aerosol-generating article further comprises an adhesive disposed between the coating and at least one of the upstream end and the downstream end of the bridging element.

* * * * *